US005111013A

United States Patent [19]

Okada

[11] Patent Number: 5,111,013

[45] Date of Patent: May 5, 1992

[54] MICROWAVE COOKING APPARATUS HAVING A LOW WAVEGUIDE

[75] Inventor: Akira Okada, Tokyo, Japan

[73] Assignee: Kabushiki Kaisha Toshiba, Kawasaki, Japan

[21] Appl. No.: 616,950

[22] Filed: Nov. 21, 1990

[30] Foreign Application Priority Data

Nov. 24, 1989 [JP] Japan ..... 1-306237

[51] Int. Cl.[5] ..... H05B 6/72

[52] U.S. Cl. ..... 219/10.55 F; 219/10.55 R

[58] Field of Search ..... 219/10.55 R, 10.55 E, 219/10.55 D, 10.55 F

[56] References Cited

U.S. PATENT DOCUMENTS 4,162,380 7/1979 Burke ..... 219/10.55 F
4,282,416 8/1981 White ..... 219/10.55 R
4,701,586 10/1987 Hagberg ..... 219/10.55 R
4,788,395 11/1988 Sakoda ..... 219/10.55 R
4,843,204 6/1989 Ueno ..... 219/10.55 R
4,888,460 12/1989 Oya ..... 219/10.55 E

FOREIGN PATENT DOCUMENTS 61-25526 6/1986 Japan ..... 219/10.55 R
02-41159 9/1990 Japan .

*Primary Examiner*—Philip H. Leung
*Attorney, Agent, or Firm*—Foley & Lardner

[57] ABSTRACT

A microwave cooking apparatus wherein a magnetron mounting part is provided by one end of a ceiling plate of an oven frame that defines a cooking chamber and a machine chamber. A recess is formed in the direction opposite to the side of the ceiling plate on which a waveguide is fixed and the magnetron is fixed to the underside of the recess so that an antenna of the magnetron projects into the waveguide.

9 Claims, 2 Drawing Sheets

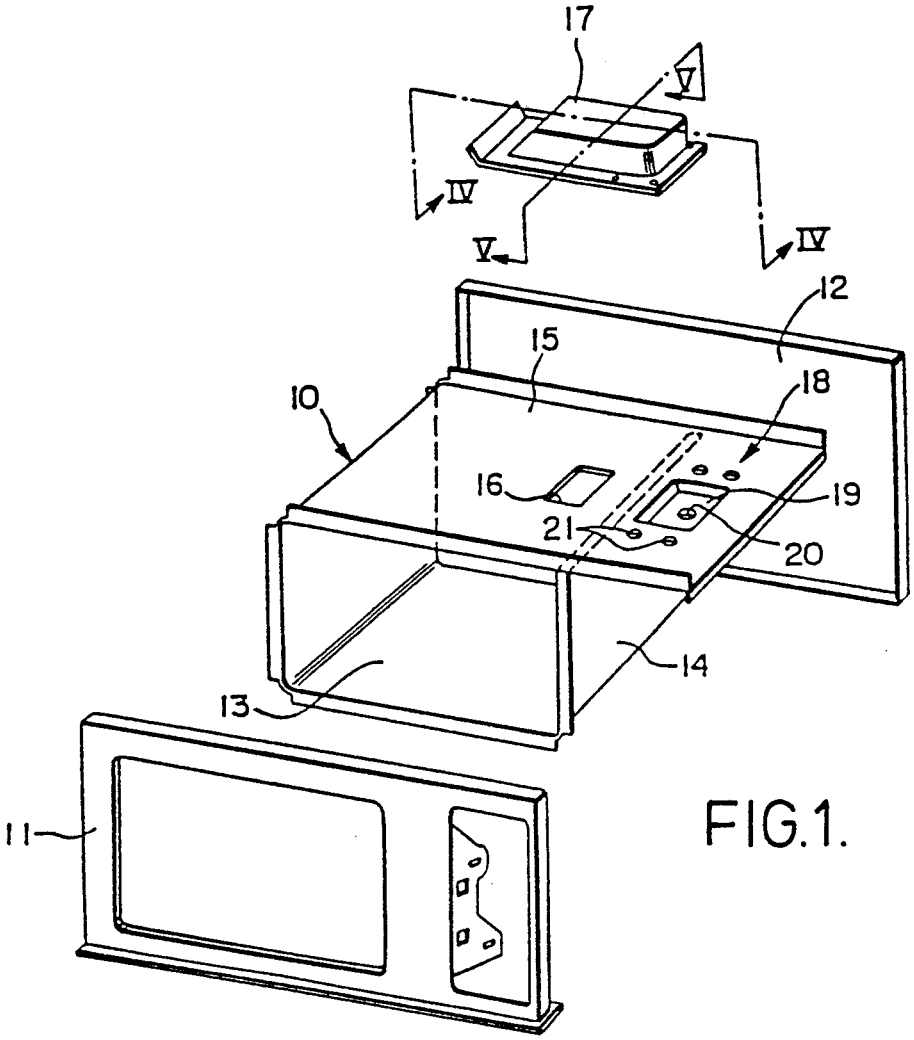
FIG.1.
FIG.2.
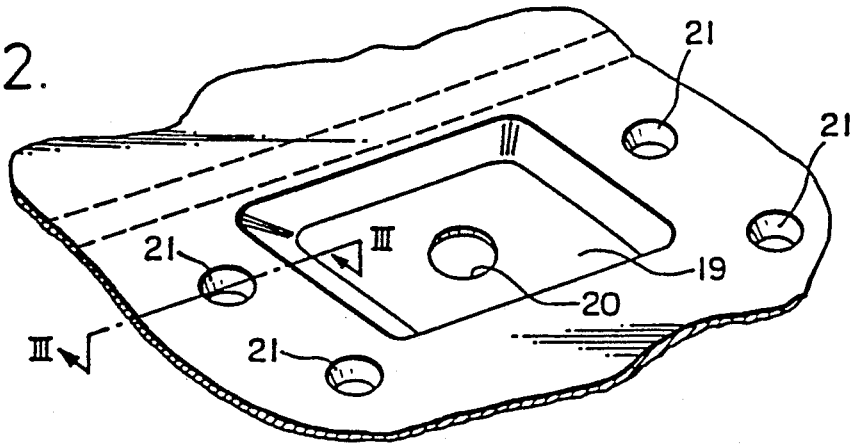

MICROWAVE COOKING APPARATUS HAVING A LOW WAVEGUIDE

BACKGROUND OF THE INVENTION

1. Field of the Invention

The present invention relates, in general, to a microwave cooking apparatus. In particular, it relates to a microwave cooking apparatus equipped with a magnetron such that the height of a waveguide can be made low.

2. Description of the Related Art

In general, in a microwave cooking apparatus, the mounting construction of the waveguide and magnetron is as described in U.S. Pat. No. 4,162,380. Specifically, Burke, in U.S. Pat. No. 4,162,380, shows a waveguide that is formed by drawing a thin sheet. The waveguide is fixed by welding or caulking to the upper surface of a ceiling plate of an oven frame that is partitioned into a cooking chamber and a machine chamber. A magnetron, extending so as to project into the machine chamber, is fixed to the bottom surface of a mounting part of the ceiling plate, with its antenna projecting into the waveguide.

However, if the magnetron is mounted as described above, a suitable gap must be added to the height of the antenna of the magnetron in order to determine the height of the waveguide. Therefore, this presents an obstacle to lowering the external height of the casing of the microwave cooking apparatus, since the lower limit of the height of the waveguide is determined by the height of the antenna.

SUMMARY OF THE INVENTION

Accordingly, it is an object of the present invention to provide an improved microwave cooking apparatus.

It is a further object of the invention to provide a microwave cooking apparatus in which the height of the waveguide can be made lower without being restricted by the magnetron antenna.

In accordance with the present invention, the foregoing objects are achieved by providing a microwave cooking apparatus, comprising a magnetron device, including an antenna portion, for generating microwave energy; an oven frame defining, a cooking chamber including a plate for accommodating food to be cooked and a ceiling plate for covering the upper portion of the cooking chamber; and a machine chamber located adjacent to the cooking chamber, wherein the ceiling plate projects into the machine chamber to form a magnetron mounting part for mounting the magnetron device, the magnetron mounting part including a recessed portion of the ceiling plate extending in the direction of the machine chamber; a waveguide for delivering microwave energy from the magnetron device into the cooking chamber, the waveguide being secured at the position of the ceiling plate substantially to cover the antenna portion of the magnetron device; a front panel mounted on the oven frame; and a back panel mounted on the oven frame.

BRIEF DESCRIPTION OF THE DRAWINGS

These and other objects and advantages of this invention will become more apparent from the following detailed description of the presently preferred embodiment of the invention, taken in conjunction with the accompanying drawings of which:

FIG. 1 is an exploded perspective view showing the oven structure of a microwave cooking apparatus according to an embodiment of the present invention;

FIG. 2 is a view to a larger scale of a magnetron mounting part of the oven frame constituting the oven structure of FIG. 1;

DETAILED DESCRIPTION OF THE PREFERRED EMBODIMENTS

Figure 3:
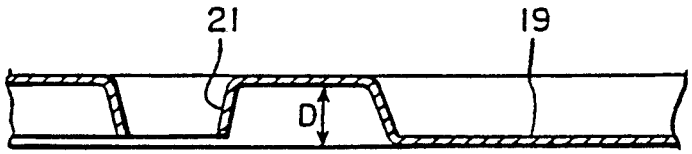
FIG. 3 is a partial vertical cross-section along the line III—III in FIG. 2.

The preferred embodiment of the present invention will now be described in more detail with reference to the accompanying drawings.

FIG. 1 shows an oven construction of a microwave cooking apparatus according to this embodiment. The oven construction consists of an oven frame 10, a front plate 11 and a back plate 12. The interior of the oven frame 10 is partitioned into a cooking chamber 13 and, outside of the cooking chamber on the right in the drawing, a machine chamber 14. An excitation port 16 is formed in ceiling plate 15 of the oven frame 10. A waveguide 17 is mounted so as to cover the excitation port 16. One end of the ceiling plate 15 projects in the direction of the machine chamber 14, forming a magnetron mounting part 18.

In the magnetron mounting part 18, a rectangular recess 19 is formed by, e.g., drawing a portion of the ceiling plate out of the plane thereof. The rectangular recess 19 is recessed in the direction opposite to the side of the ceiling plate 15 to which the fixing waveguide 17 is attached. A through hole 20 is punched at the center of the recess 19. Also, as shown in FIGS. 2 and 3, a specified number of drawn holes 21,21, constituting truncated circular conical recesses, are formed at the periphery of the recess 19. The drawn holes 21,21 are for mounting the magnetron 22 and are formed to have a depth less than the depth D of the recess 19.

Figure 4:
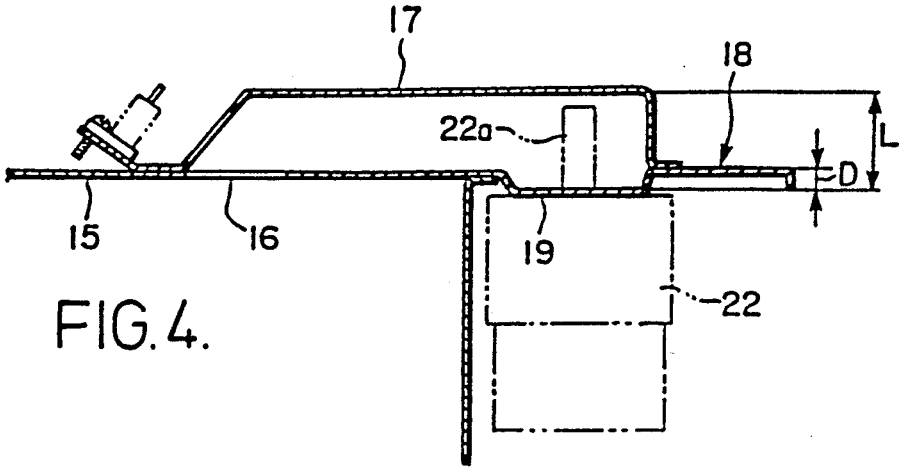
FIG. 4 is a partial vertical cross-section along the line IV—IV in FIG. 1.
Figure 5:
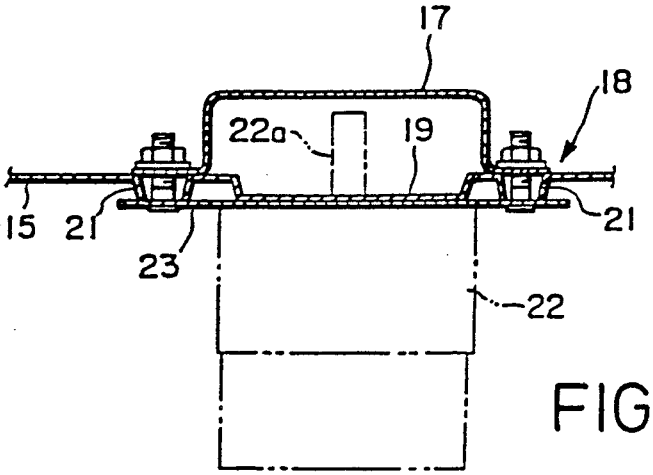
FIG. 5 is a partial vertical cross-section along the line V—V in FIG. 1.

The magnetron 22 is mounted as follows, as shown in FIGS. 4 and 5. Specifically, the magnetron 22 is fixed to the bottom face of the recess 19, with the antenna **22*a* of the magnetron 22 projecting into the interior of the waveguide 17 from the through hole 20 of the recess 19. In this case, the magnetron 22 is fixed to the underside of the recess 19 by means of a mounting plate 23 by attaching nuts to bolts inserted in drawn holes 21. In this way, the height of the waveguide 17 can be made lower, owing to the manner of fixing the magnetron 22. Basically, the waveguide 17 needs to have a height as indicated by symbol L in FIG. 4, arrived at by adding a suitable separation between the antenna tip and the waveguide 17 to the height of the antenna 22*a* of the magnetron 22. However, with this invention, since the magnetron 22 is mounted on the underside of the recess 19, which is recessed in the direction opposite to the side on which the waveguide 17 is fixed, the antenna 22*a* of the magnetron 22 is positioned lower by the depth D of the recess 19. Thus, the height L of the waveguide 17 can be made lower to that extent. As a result, the height of the waveguide 17** can be set without being restricted by the height of the antenna.

Furthermore, by utilizing truncated circular conical drawn holes 21,21 . . . provided at the periphery of the recess 19 for the fixing of the magnetron 22 as aforesaid, these drawn holes 21,21 . . . perform the function of reinforcing magnetron mounting part 18, which is in the form of a thin sheet. This prevents the inconvenience of deformation of the mounting location, which can occur when the nuts and bolts are tightened.

Numerous other modifications and variations of the present invention are possible in light of the above teachings. It is therefore to be understood that, within the scope of the appended claims, the present invention can be practiced in a manner other than as specifically described herein

What is claimed is:

1. A microwave cooking apparatus, comprising:

a magnetron device, including an antenna portion, for generating microwave energy;

an oven frame defining:

a cooking chamber including a plate for accommodating food to be cooked and a ceiling plate for covering the upper portion of said cooking chamber;

a machine chamber located adjacent to said cooking chamber, wherein a planar recessed portion drawn out of a plane of said ceiling plate and having an opening projects into said machine chamber to form a magnetron mounting part for mounting said magnetron device;

a waveguide for delivering microwave energy from said magnetron device into said cooking chamber, said waveguide being secured at the position of said ceiling plate substantially to cover the antenna portion of said magnetron device;

a front panel mounted on said oven frame; and a back panel mounted on said oven frame.

2. The apparatus according to claim 1, including an excitation port for entry of magnetron energy into said cooking chamber, formed in said ceiling plate of said cooking chamber.

3. The apparatus according to claim 2, wherein the waveguide is mounted to cover said excitation port.

4. The apparatus according to claim 1, wherein the recess has an essentially rectangular configuration.

5. The apparatus according to claim 1, including the recess formed by drawing.

6. The apparatus according to claim 1, including a through hole punched substantially at the center of said recess.

7. The apparatus according to claim 1, including a plurality of drawn holes formed at the periphery of said recess.

8. The apparatus according to claim 7, wherein each of said drawn holes has a truncated circular conical configuration.

9. The apparatus according to claim 8, wherein each of said drawn holes has a depth shallower than said recess.

* * * * *